US010737275B2

(12) United States Patent
Johnson et al.

(10) Patent No.: US 10,737,275 B2
(45) Date of Patent: Aug. 11, 2020

(54) MILL BOX FOR A HORIZONTAL GRINDER

(71) Applicant: Vermeer Manufacturing Company, Pella, IA (US)

(72) Inventors: Brian Michael Johnson, Monroe, IA (US); Jeffrey Belloma, Pella, IA (US); Duane Allen Harthoorn, Lynnville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 316 days.

(21) Appl. No.: 15/673,806

(22) Filed: Aug. 10, 2017

(65) Prior Publication Data

US 2018/0141051 A1 May 24, 2018

Related U.S. Application Data

(60) Provisional application No. 62/424,834, filed on Nov. 21, 2016, provisional application No. 62/453,282, filed on Feb. 1, 2017.

(51) Int. Cl.
*B02C 18/14* (2006.01)
*B02C 18/22* (2006.01)
(Continued)

(52) U.S. Cl.
CPC ..... *B02C 18/225* (2013.01); *B02C 13/06* (2013.01); *B02C 13/13* (2013.01); *B02C 13/286* (2013.01);
(Continued)

(58) Field of Classification Search
CPC ..... B02C 13/06; B02C 13/13; B02C 13/286; B02C 2013/28636; B02C 2013/28645;
(Continued)

(56) References Cited

U.S. PATENT DOCUMENTS 3,966,128 A 6/1976 Anderson et al.
4,033,515 A 7/1977 Barcell et al.
(Continued)

FOREIGN PATENT DOCUMENTS

WO 2013/096783 6/2013

OTHER PUBLICATIONS

Partial International Search Report for Application No. PCT/US2017/045562 dated Nov. 16, 2017.

*Primary Examiner* — Faye Francis
(74) *Attorney, Agent, or Firm* — Armstrong Teasdale LLP

(57) ABSTRACT

A material reducing machine includes a rotary reducing drum that is rotatable about an axis of rotation and defines a reducing boundary that extends at least partially around the axis of rotation. The material reducing machine includes an infeed conveyor for transporting material to a front portion of the rotary reducing drum and defines a conveyor plane. The material reducing machine includes a mill box at least partially surrounding the rotary reducing drum and including a mill box lid mounted generally above the rotary reducing drum. The mill box lid has an inlet edge positioned above a rear portion of the rotary reducing drum and an outlet edge positioned above the front portion of the rotary reducing drum. The mill box includes an infeed opening that is configured to receive material from a feed table and has an upper opening defined by the outlet edge of the mill box lid.

11 Claims, 13 Drawing Sheets

(51) Int. Cl.

| | |
|---|---|
| ***B02C 18/18*** | (2006.01) |
| ***B02C 13/06*** | (2006.01) |
| ***B02C 13/13*** | (2006.01) |
| ***B02C 13/286*** | (2006.01) |
| ***B02C 21/02*** | (2006.01) |
| *B02C 18/16* | (2006.01) |

(52) U.S. Cl.
CPC ..... *B02C 18/14* (2013.01); *B02C 18/18* (2013.01); *B02C 21/026* (2013.01); *B02C 2013/28636* (2013.01); *B02C 2013/28645* (2013.01); *B02C 2018/162* (2013.01); *B02C 2018/188* (2013.01)

(58) Field of Classification Search
CPC ..... B02C 21/026; B02C 18/14; B02C 18/225; B02C 2018/188
USPC ..... 241/101.76, 101.74, 186.35
See application file for complete search history.

(56) References Cited

U.S. PATENT DOCUMENTS 5,350,122 A 9/1994 Hundt et al.
5,413,286 A * 5/1995 Bateman ..... B02C 13/04 241/190
5,713,525 A 2/1998 Morey
5,863,003 A 1/1999 Smith
5,881,959 A * 3/1999 Hadjinian ..... B02C 18/145 241/186.35
5,890,666 A 4/1999 Fölling et al.
5,947,395 A * 9/1999 Peterson ..... B02C 18/225 241/223
5,975,443 A * 11/1999 Hundt ..... B02C 13/284 241/189.1
6,207,228 B1 3/2001 Hundt et al.
6,227,469 B1 5/2001 Daniels, Jr. et al.
6,299,082 B1 * 10/2001 Smith ..... B02C 18/145 241/186.35
6,371,393 B1 4/2002 Köhl et al.
6,412,715 B1 7/2002 Brand et al.
6,742,732 B1 6/2004 Hundt et al.
6,843,435 B2 * 1/2005 Verhoef ..... B02C 13/09 241/73
7,204,442 B2 4/2007 Roozeboom et al.
7,258,293 B2 * 8/2007 Tanaka ..... B02C 18/225 241/186.35
7,441,719 B2 * 10/2008 Verhoef ..... B02C 13/09 241/285.3
7,461,802 B2 12/2008 Smidt et al.
7,527,212 B2 * 5/2009 Kitaguchi ..... B02C 13/286 241/186.35
7,896,274 B2 * 3/2011 Roozeboom ..... B02C 18/18 241/186.35
7,942,356 B2 5/2011 Dallimore et al.
7,971,818 B2 7/2011 Smidt et al.
2002/0125356 A1 * 9/2002 Bardos ..... B02C 13/095 241/242
2004/0135018 A1 7/2004 Bonner
2005/0098671 A1 * 5/2005 Verhoef ..... B02C 13/09 241/285.3
2005/0194478 A1 * 9/2005 Tanaka ..... B02C 18/225 241/28
2005/0253003 A1 11/2005 Bonner
2006/0027690 A1 * 2/2006 Verhoef ..... B02C 13/09 241/73
2007/0102549 A1 * 5/2007 Kitaguchi ..... B02C 13/286 241/186.4
2007/0176034 A1 * 8/2007 Roozeboom ..... B02C 18/18 241/242
2009/0140089 A1 6/2009 Boast
2012/0043403 A1 * 2/2012 Roozeboom ..... B02C 13/06 241/25
2013/0200189 A1 8/2013 Harthoorn et al.
2013/0341449 A1 * 12/2013 Dux ..... B02C 18/18 241/222
2014/0175201 A1 * 6/2014 Peterson ..... B02C 18/18 241/69
2014/0319250 A1 10/2014 Roozeboom et al.
2015/0001323 A1 1/2015 Rikkonen et al.

* cited by examiner

MILL BOX FOR A HORIZONTAL GRINDER

CROSS REFERENCE TO RELATED APPLICATIONS

This application claims the benefit of U.S. Provisional Application No. 62/424,834, filed Nov. 21, 2016; and U.S. Provisional Application No. 62/453,282, filed Feb. 1, 2017, the disclosures of which are hereby incorporated herein by reference.

BACKGROUND

Reducing machines are machines used to grind, chip, shred, or otherwise mechanically break down larger pieces of material into smaller pieces of material. One common type of reducing machine is known as a horizontal grinder.

A horizontal grinder typically includes a horizontally oriented power infeed mechanism that forces material into contact with a rotating grinding drum at the side of the drum. This configuration allows the material to be introduced to the drum at one side while also allowing material to be ejected through a screen, onto a discharge conveyor, at the bottom side and the opposite side of the drum from where the drum receives the material. Further the configuration allows any un-processed material at the top of the drum to be directed back to the infeed area. Specifically, some horizontal grinders have a rotating drum that operates at speeds greater than 500 RPM, and often in excess of 1000 RPM. The speed at which the rotating drum operates affects both the size reduction characteristics of the drum and the characteristics surrounding how material is fed to the rotating drum.

Many different types of material are processed with horizontal grinders. Some materials can be difficult to feed including various forms of wood-based material such as tree trunks, tree branches, logs, root balls. Woody materials, and many other materials as-well, are resilient, do not shear easily, and tend to self-feed. Self-feeding is not desirable as it can result in inconsistent loads on the drum, inconsistent productivity, and inconsistent quality of the ground product. The self-feeding tendency is affected by where the material is presented to the drum. Infeed systems that present material towards the bottom of the drum, where the material is presented nearly tangent to the path of travel of the teeth of the drum, tend to have frequent self-feeding. For example, U.S. Pat. No. 6,227,469 illustrates a horizontal grinder that presents material towards the bottom. This patent describes a solution for the self-feeding tendency associated with that configuration. In another example, U.S. Patent Publication No. 2005/0253003 discloses presenting material more toward the center-line of the drum. When material is fed toward the bottom of the drum, larger material can be introduced as compared to when material is fed closer to the centerline of the drum. This is due to the size of the infeed opening, which is the vertical distance between an in-feed mechanism and the exposed top of the drum, is larger. However, while introducing material toward the lower part of the drum allows for larger material to be processed, raising the point at which material is fed to the drum reduces the tendency for self-feeding.

After material is presented to the drum, which is mounted in a mill box, it is contacted by teeth carried by the grinding drum. Portions of the material are forced past a fixed shear edge defined by an anvil of the horizontal grinder. Upon passing the fixed shear edge of the anvil, the material enters the mill box defined at least in part by a screen that extends around a portion of the grinding drum and a mill housing that extends around, in close proximity to, a portion of the grinding drum. Within the mill box, the material is further reduced by the teeth carried by the grinding drum and interacting with the screen. Once the material within the mill box is reduced to a certain particle size, the material is discharged through the screen. Upon passing through the screen, the reduced material is typically deposited on a discharge conveyor that carries the reduced material to a collection location. An example horizontal grinder is disclosed in U.S. Pat. Nos. 7,971,818 and 7,441,719 which are hereby incorporated by reference in their entirety. The mill box also includes a top cover that directs material not passing through the screen back to the infeed. This overall arrangement results in an infeed opening defined at the bottom by the powered infeed mechanism and at the top by the mill lid that defines the exposed top of the drum.

A need exists for a horizontal grinder arranged to maximize the infeed opening, while limiting the self-feeding tendency.

SUMMARY

The present disclosure relates generally to a horizontal grinder. In one possible configuration, and by non-limiting example, the horizontal grinder body includes an arcuate mill lid that extends away from a rotary reducing drum.

In one aspect of the present disclosure, a material reducing machine is disclosed. The material reducing machine includes a rotary reducing drum that is rotatable about an axis of rotation and defines a reducing boundary that extends at least partially around the axis of rotation. The material reducing machine includes an infeed conveyor for transporting material to a front portion of the rotary reducing drum. The infeed conveyor defines a conveyor plane. The material reducing machine includes a mill box at least partially surrounding the rotary reducing drum. The mill box includes a mill box lid mounted generally above the rotary reducing drum, the mill box lid having an inlet edge positioned above a rear portion of the rotary reducing drum and an outlet edge positioned above the front portion of the rotary reducing drum. The mill box lid extends away from the reducing boundary when extending from the inlet edge to the outlet edge in an arcuate path toward a feed table. The outlet edge is positioned above an uppermost edge of the rotary reducing drum. The mill box includes an infeed opening that is configured to receive material from the feed table. The infeed opening has an upper opening defined by the outlet edge of the mill box lid.

In another aspect of the present disclosure, a material reducing machine with reduced tendency for self-feeding is disclosed. The material reducing machine includes a rotary reducing drum that is rotatable about an axis of rotation and defines a reducing boundary that extends at least partially around the axis of rotation. The material reducing machine includes an infeed conveyor for transporting material to a front portion of the rotary reducing drum. The infeed conveyor defines a conveyor plane. The material reducing machine includes an anvil being positioned between the rotary reducing drum and the infeed conveyor. The anvil has a leading tip positioned immediately adjacent the reducing boundary. At least a portion of the anvil extends above the conveyor plane. The anvil is positioned at a first angle with respect to the conveyor plane. The first angle is greater than or equal to about 6 degrees and less than or equal to about 10 degrees. The anvil is also positioned at a second angle with respect to the reducing boundary of the rotary reducing drum. A first reference plane extends from the axis of rotation of the rotary reducing drum to the leading tip of the anvil. A second reference plane extends downward perpendicular to the first reference plane. A reduced tendency for self-feeding is provided when the anvil and infeed conveyor positioned in this relative orientation and when the anvil and infeed conveyor are positioned so that the second reference plane forms the second angle with the conveyor plane of between about 122 degrees and about 130 degrees.

In another aspect of the present disclosure, a material reducing machine is disclosed. The material reducing machine includes a rotary reducing drum that is rotatable about an axis of rotation and defines a reducing boundary that extends at least partially around the axis of rotation. The material reducing machine includes an infeed conveyor for transporting material to a front portion of the rotary reducing drum. The infeed conveyor defines a conveyor plane. The material reducing machine includes a mill box at least partially surrounding the rotary reducing drum. The mill box includes a mill box lid mounted generally above the rotary reducing drum, the mill box lid having an inlet edge positioned above a rear portion of the rotary reducing drum and an outlet edge positioned above the front portion of the rotary reducing drum. The mill box lid extends away from the reducing boundary when extending from the inlet edge to the outlet edge in an arcuate path toward a feed table. The outlet edge is positioned above an uppermost edge of the rotary reducing drum. The mill box includes an infeed opening that is configured to receive material from the feed table. The material reducing machine includes an anvil being positioned between the rotary reducing drum and the infeed conveyor. The anvil has a leading tip positioned immediately adjacent the reducing boundary. At least a portion of the anvil extends above the conveyor plane. The anvil is positioned at a first angle with respect to the conveyor plane. The first angle is greater than or equal to about 6 degrees and less than or equal to about 10 degrees. The anvil is also positioned at a second angle with respect to the reducing boundary of the rotary reducing drum. A first reference plane extends from the axis of rotation of the rotary reducing drum to the leading tip of the anvil. A second reference plane extends downward perpendicular to the first reference plane. The second reference plane forms the second angle with the conveyor plane. The second angle is between about 122 degrees and about 128 degrees.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
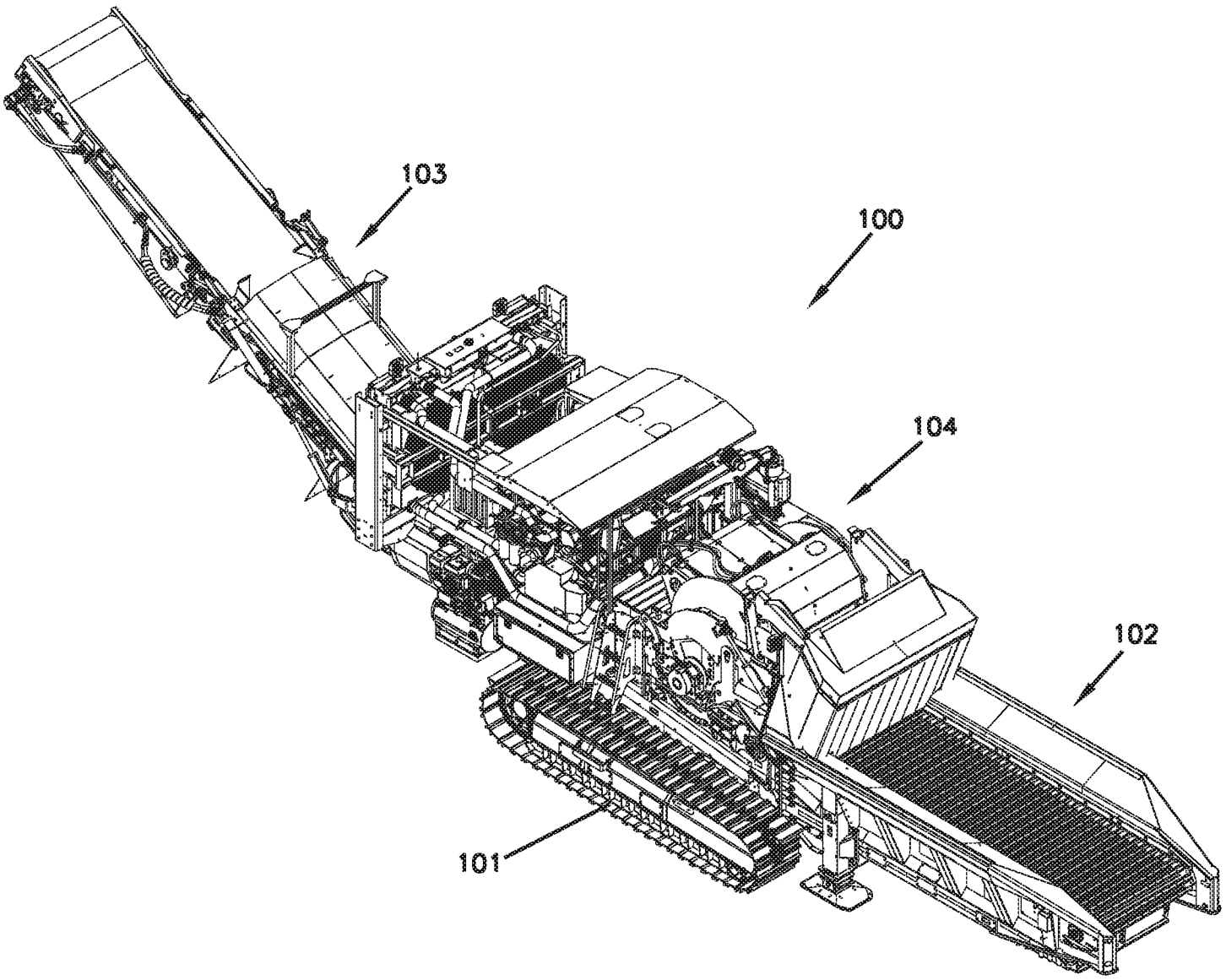
FIG. 1 illustrates a perspective view of a horizontal grinder, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A traditional horizontal grinder includes an infeed system, a reducing system, and an outfeed system. The present disclosure will be focused around the infeed system and the reducing system of a horizontal grinder; therefore, certain portions of the horizontal grinder will not be shown or described herein.

The mill box lid described herein has several advantages. The mill box lid improves the ability of the mill box to receive material sized larger than the diameter of the rotary reducing drum. Further, the mill box lid disclosed herein aids in improving the operating characteristics and the wear life of the rotary reducing drum and mill box lid by reducing the force generated by material between the mill box lid and the rotary reducing drum.

Figure 2:
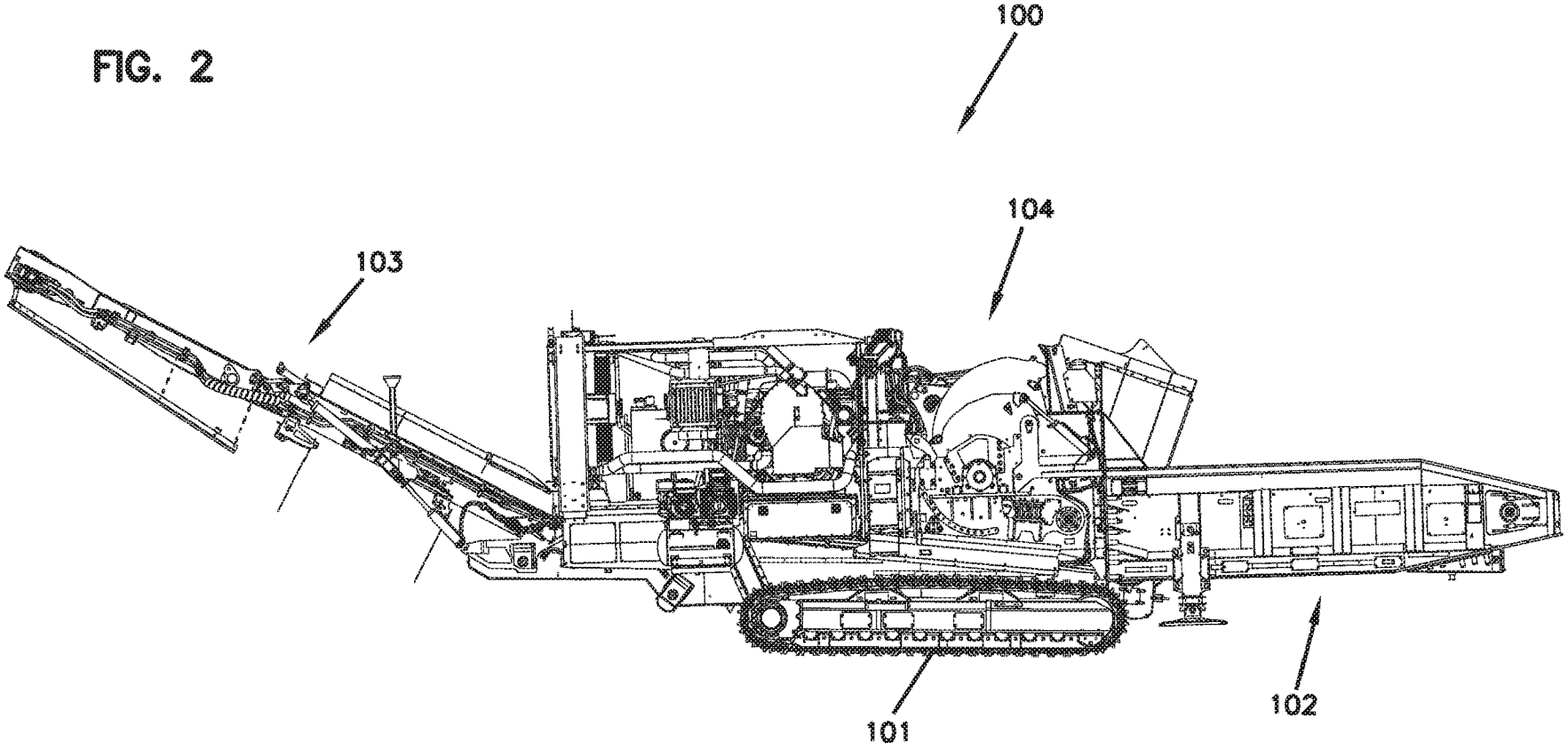
FIG. 2 illustrates a side view of the horizontal grinder of FIG. 1.

FIGS. 1 and 2 show a horizontal grinder 100. The horizontal grinder 100 includes an infeed system 102, an outfeed system 103, a mill box 104, and a rotary reducing drum 106 mounted within the mill box 104. In the depicted embodiment, the horizontal grinder 100 includes tracks 101 capable of transporting the horizontal grinder 100. The horizontal grinder 100 is configured to receive material at the infeed system 102, pass the material to the mill box 104 where it is ground to a smaller material, and then output the ground material via the outfeed system 103.

Figure 3:
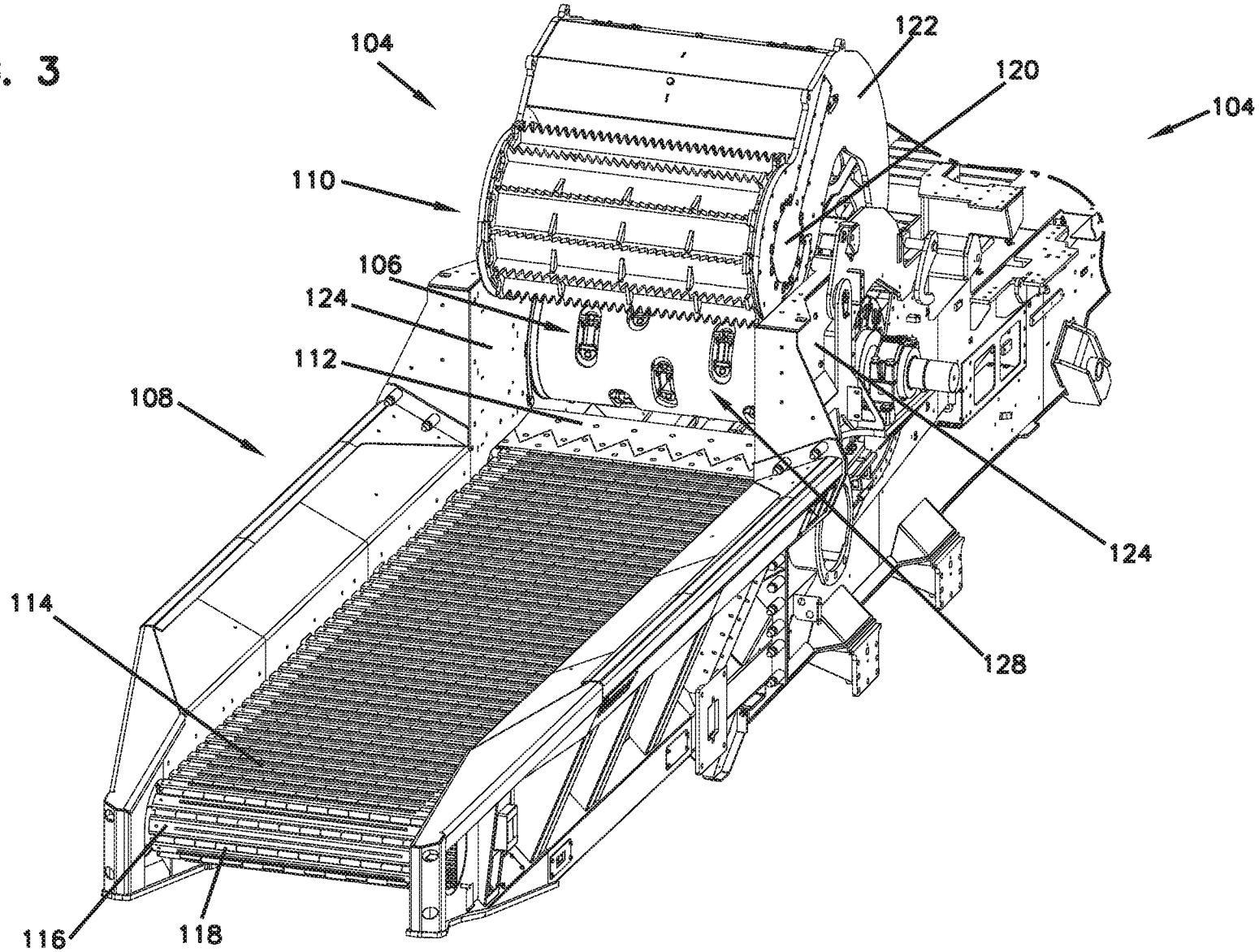
FIG. 3 illustrates a perspective view of a portion of the horizontal grinder of FIG. 1.

FIG. 3 shows a portion of the horizontal grinder 100. The infeed system 102 includes a feed table 108, a feed roller 110, and an anvil 112. The feed table 108 and feed roller 110 are configured to move material into the mill box 104 for a grinding operation.

The feed table 108 includes an infeed conveyor 114. The infeed conveyor 114 includes a plurality of conveyor bars 116 that are attached to a plurality of conveyor chains 118.

In some embodiments, the conveyor chains 118 are routed around a front conveyor roller 118*a* and rear conveyor roller 118*b* (shown in FIGS. 10-12) positioned at either end of the infeed conveyor 114. In some embodiments, the rear conveyor roller 118*b* is powered, typically by a hydraulic motor, in a manner that allows conveyor chain 118 and the conveyor bars 116 to be propelled in either direction toward the mill box 104 or away from the mill box 104.

The anvil 112 is located at the rear of the infeed system 102. The anvil 112 is located such that rotation of the rotary reducing drum 106 will move the material from the infeed system 102 into contact with the anvil 112.

The feed roller 110 is rotatably mounted on a feed roller shaft 120 and supported on mount arms 122 that are pivotally connected to the horizontal grinder 100. During operation, material is propelled or conveyed towards a mill box 104 by the infeed conveyor 114. As the material is conveyed, the feed roller 110 (driven by a hydraulic motor not shown) engages the material to provide additional feed pressure to urge the material towards the mill box 104. Further, the feed roller 110 is configured for vertical movement, movement wherein the feed roller can move up, away from the infeed conveyor 114 by the mount arms 122 so as to accommodate material having a variety of different heights. In FIG. 3, the feed roller 110 is shown in a partially raised position.

The mill box 104 is configured to contain the rotary reducing drum 106. The mill box 104 is also configured to contain material within the mill box 104 until the rotary reducing drum 106 has ground the material. The mill box 104 includes a pair of side walls 124 and a mill box lid 126 positioned over the rotary reducing drum 106. The mill box lid 126 will be discussed in more detail with respect to FIGS. 4-6.

The mill box 104 further includes an infeed opening 128 that is configured to receive material from the feed table 108. The feed roller 110 is configured to move vertically in front of the infeed opening 128, as shown in FIG. 3.

The rotary reducing drum 106 is rotationally driven about an axis of rotation by a drive mechanism (not shown). One example of a drum is described in more detail in U.S. Pat. No. 7,204,442, which is incorporated herein by reference. The rotary reducing drum 106 is located adjacent the infeed system 102. The rotary reducing drum 106 can carry any number of material reducing components 107 (e.g., edges, grinding members, cutters, plates, blocks, blades, bits, teeth, hammers, shredders, or combinations thereof) supported in any preferred method. In certain embodiments, the material reducing components 107 can have a blunt configuration having a blunt impact region. However, in other embodiments, material reducing components with sharp edges/blades or points suitable for chipping or cutting can be used.

Figure 4:
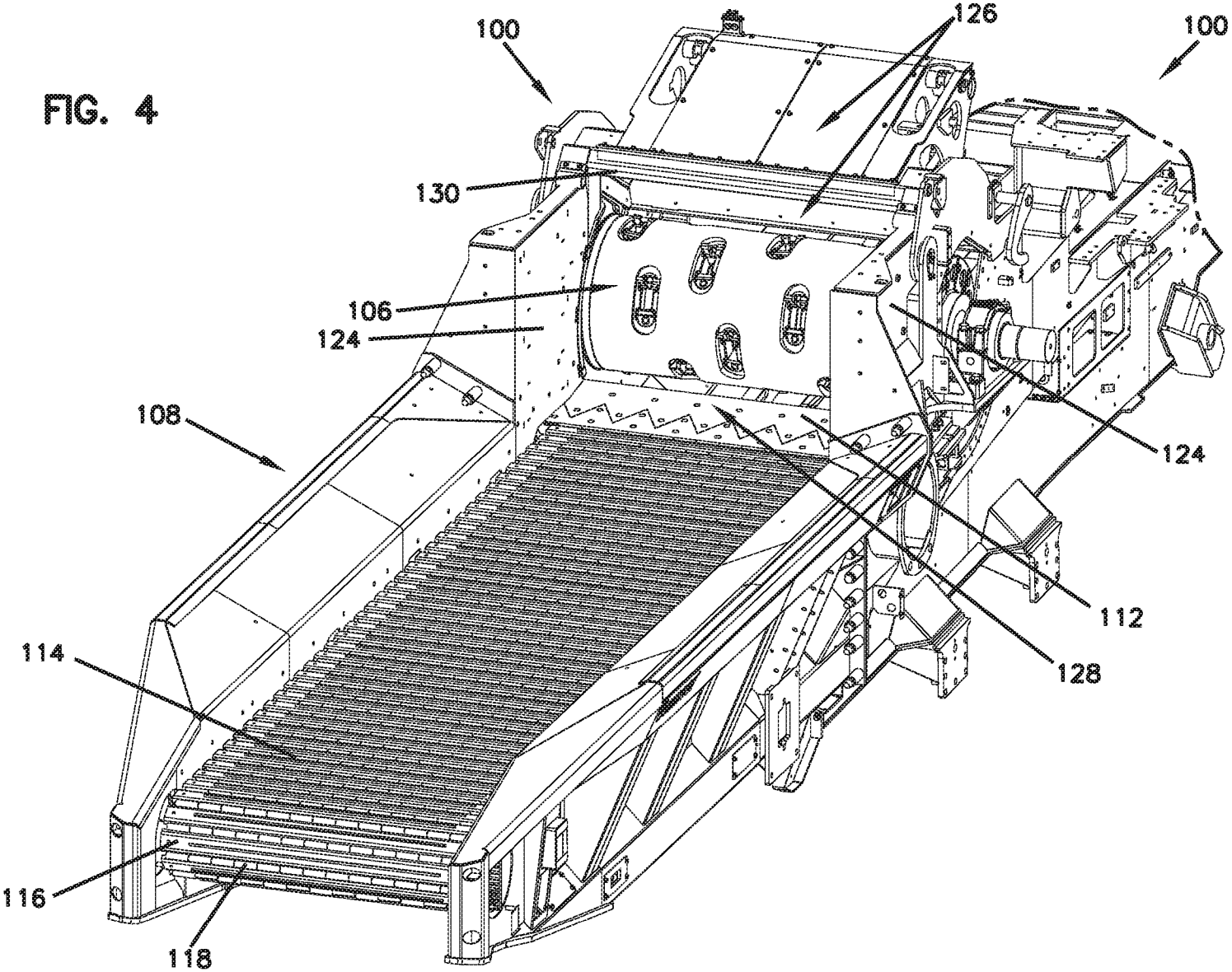
FIG. 4 illustrates a perspective view of a portion of the horizontal grinder of FIG. 1 without a feed roller.
Figure 5:
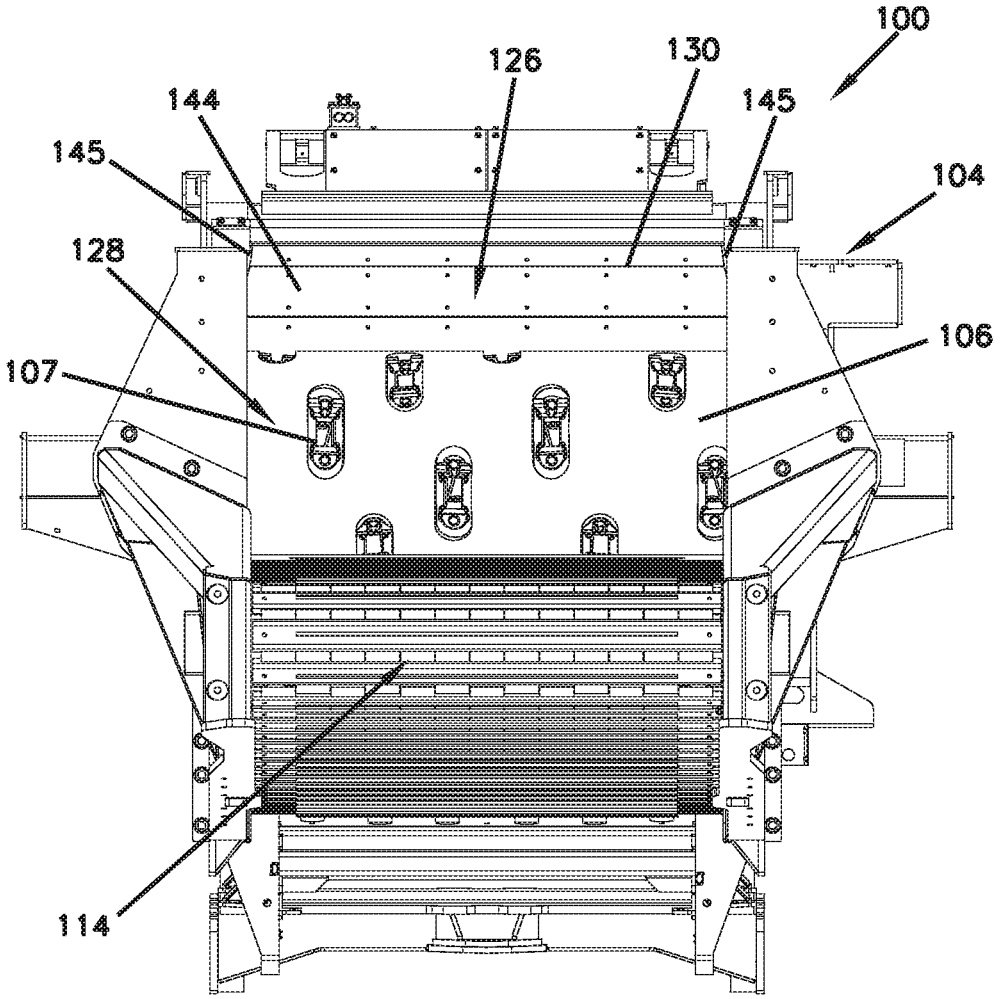
FIG. 5 illustrates a front view of the horizontal grinder of FIG. 1.
Figure 6:
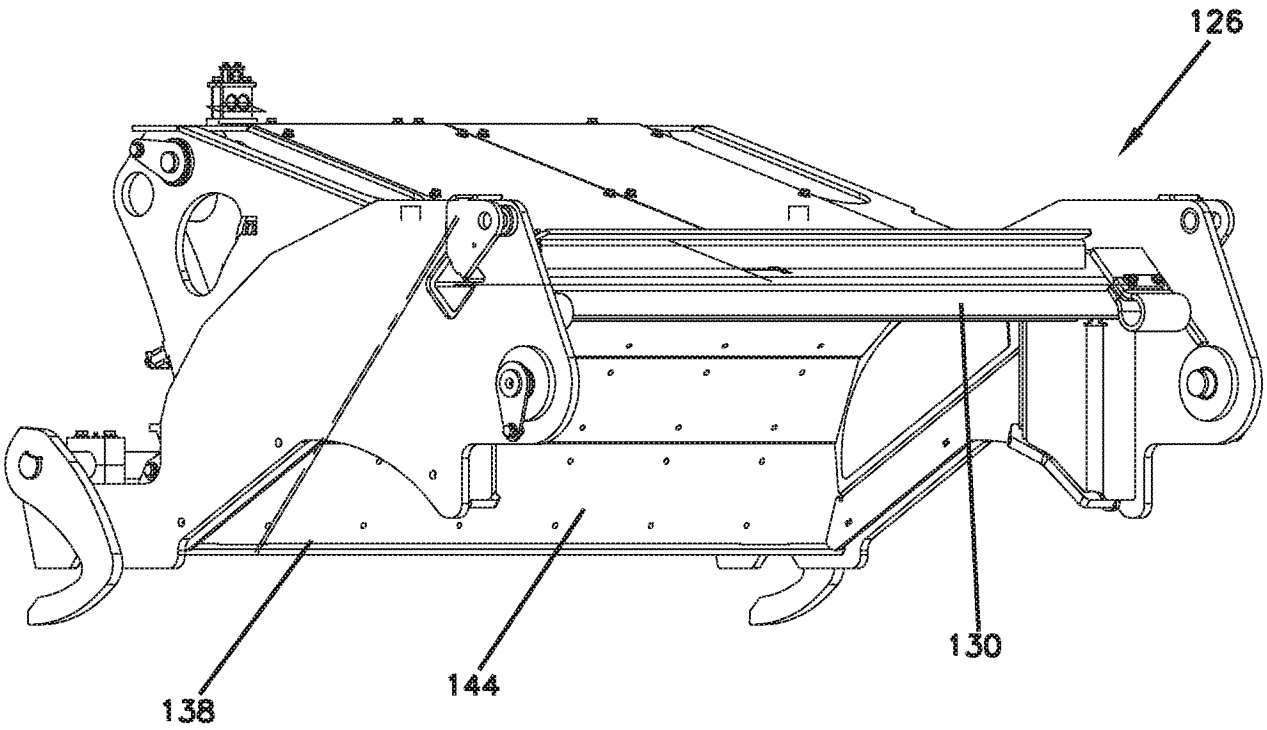
FIG. 6 illustrates a perspective view of a mill box lid, according to one embodiment of the present disclosure.
Figure 7:
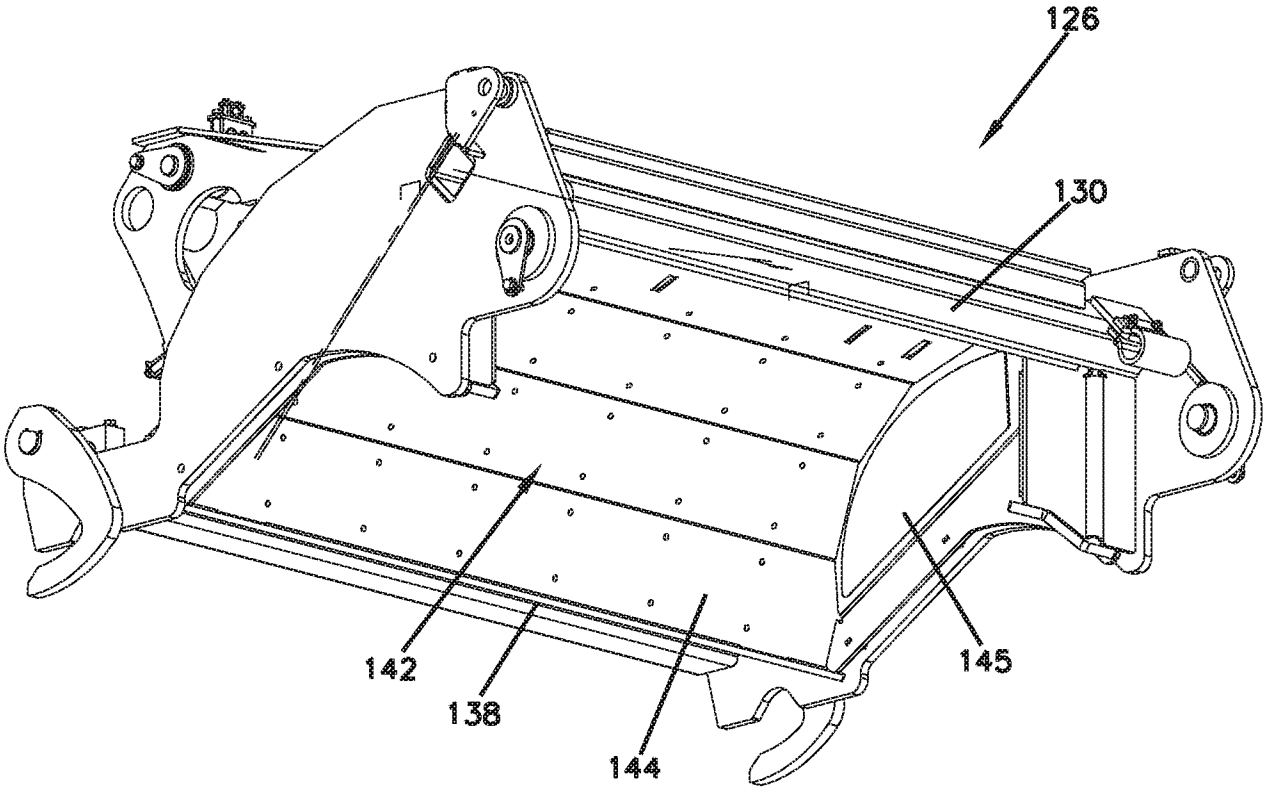
FIG. 7 illustrates a perspective view of a portion of the mill box lid of FIG. 6.

FIG. 4 shows the horizontal grinder 100 without the feed roller 110. FIG. 5 shows a front view of the horizontal grinder 100 along the infeed conveyor 114. As shown, the infeed opening 128 of the mill box 104 is defined at an upper boundary by an outlet edge 130 of the mill box lid 126 and at a lower boundary by the anvil 112. The mill box lid 126 lid is shown to include a plurality of wear plates 144 that generally surround the drum 106. The mill box lid 126 also includes a pair of angled side deflectors 145 that are configured to reroute material in the mill box 104 in a direction toward the middle of the drum 106.

FIGS. 6-9 show the mill box lid 126. The mill box lid 126 is fixed to the mill box 104 during the operation of the horizontal grinder 100. The mill box lid 126 includes an inner surface that is directly adjacent the drum 106 of the horizontal grinder. The inner surface interacts with materials during the grinding operation. Specifically, the mill box lid 126 includes the outlet edge 130, an inlet edge 138, an outlet portion 140, and an intermediate section 142 between the outlet portion 140 and the inlet edge 138 that optionally includes the plurality of replaceable wear plates 144.

Figure 8:
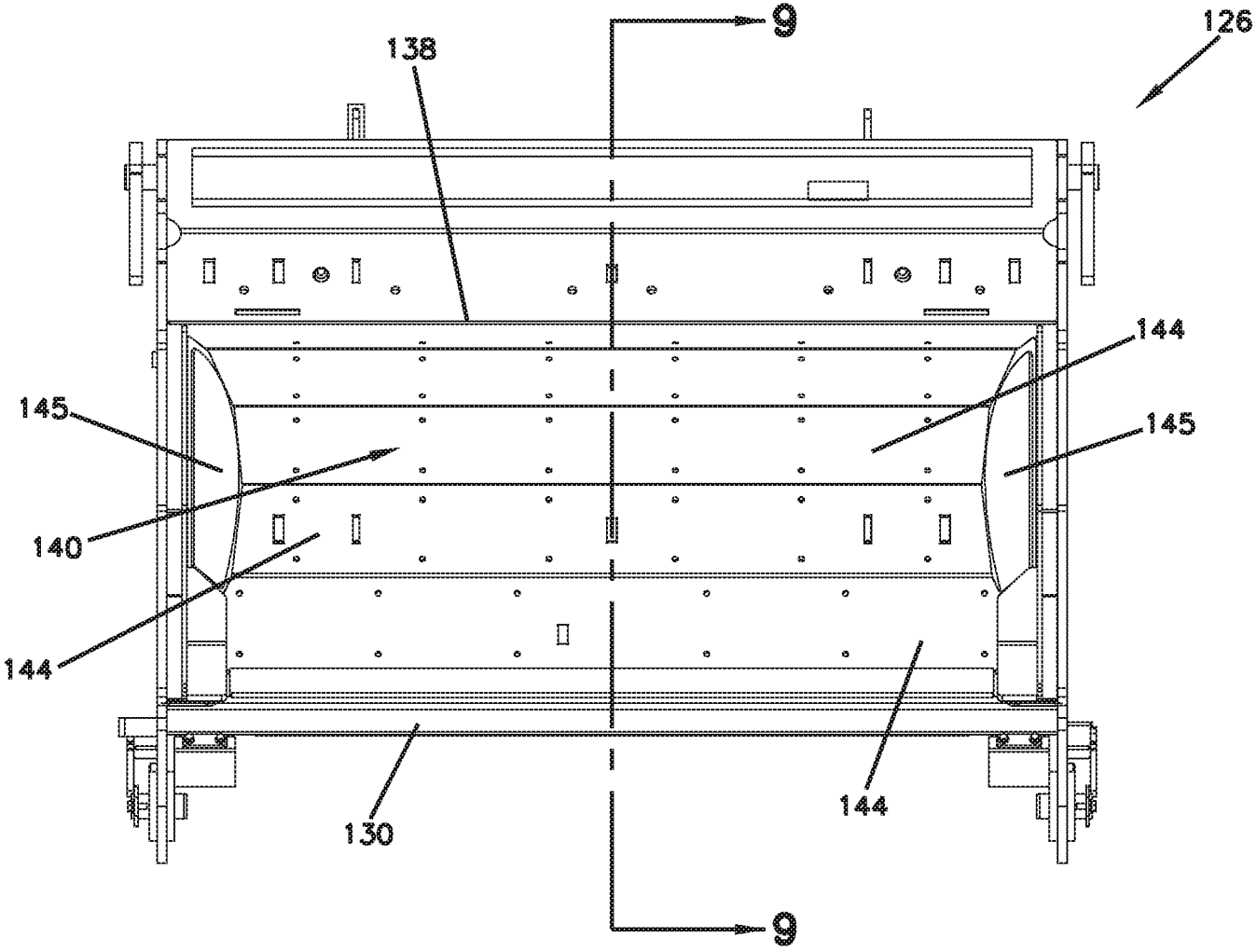
FIG. 8 illustrates a bottom view of the mill box lid of FIG. 6.

FIG. 8 shows a bottom view of the mill box lid 126. As shown, the angled side deflectors 145 and wear plates 144 line the inside surface of the mill box lid 126. Specifically, the angled side deflectors 145 are angled from the edges of the mill box lid 126 toward the center of the mill box lid 126. In some embodiments, the wear plates 144 and angled side deflectors 145 are replaceable.

Figure 9:
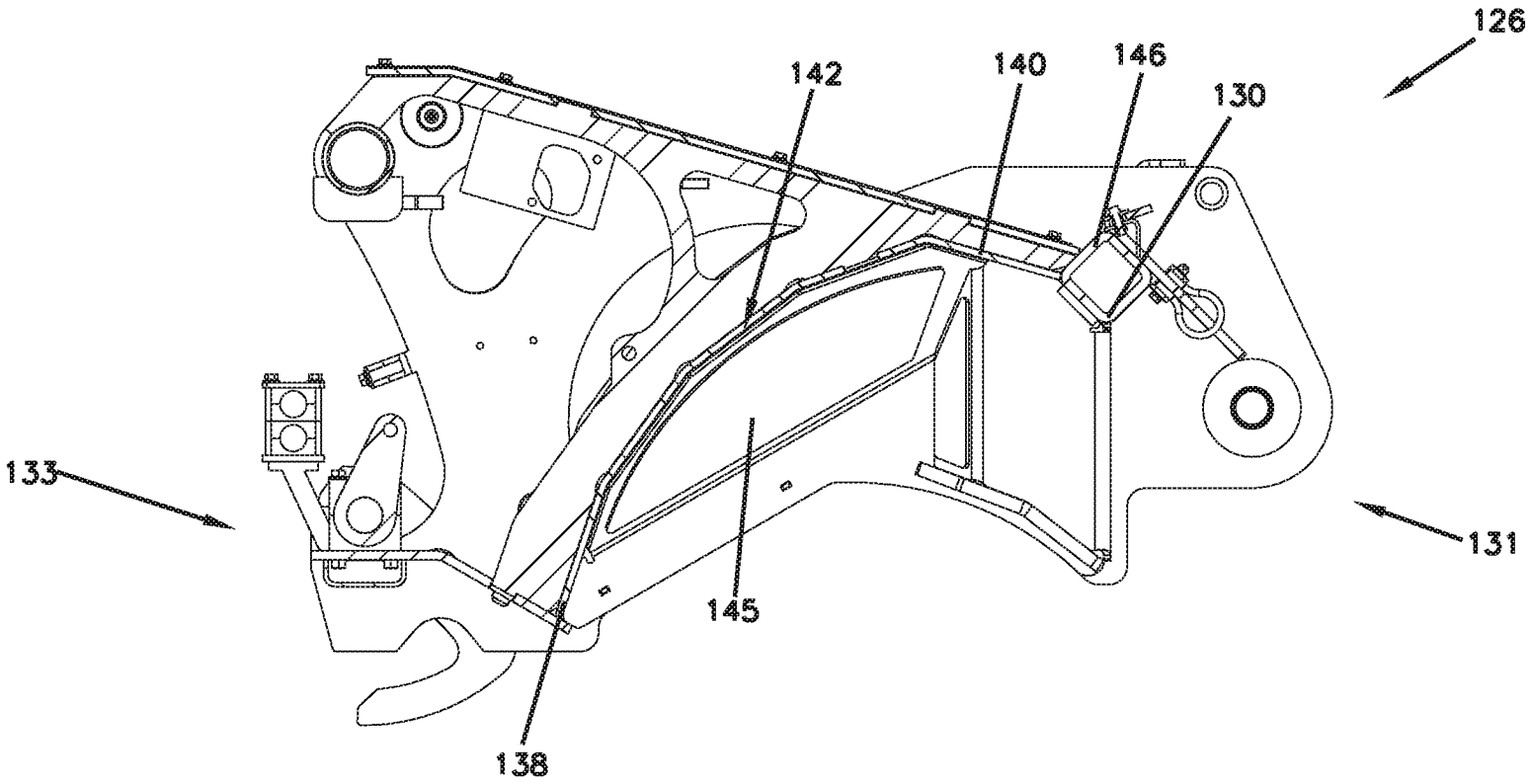
FIG. 9 illustrates a cross-sectional view along line 9-9 of the mill box lid of FIG. 6.

FIG. 9 shows a cross-sectional view of the mill box lid 126. The mill box lid 126 has a generally arcuate profile. In some embodiments, the mill box lid 126 can have a generally continuous curved profile when extending from the inlet edge 138 to the outlet edge 130. In some embodiments, the mill box lid 126 has a generally parabolic profile when extending from the inlet edge 138 to the outlet edge 130. The profile of the mill box lid 126 is configured to allow material to follow the profile of the mill box lid 126 from the inlet edge 138 to the outlet edge 130 when in the mill box 104.

The outlet edge 130 is positioned at a location near a front portion 131 of the mill box lid 126. In some embodiments, the outlet edge 130 of the mill box lid 126 includes a breaker bar 146.

The inlet edge 138 of the mill box lid 126 is positioned generally at a location near a rear portion 133 of the mill box lid 126.

The outlet portion 140 of the mill box lid 126 is configured to extend in a downward direction when extending to the outlet edge 130. The outlet portion 140 of the mill box lid 126 is configured to direct material that travels along the profile of the mill box lid 126 in a downward direction.

The intermediate section 142 of the mill box lid 126 is positioned between the outlet portion 140 and the inlet edge 138 of the mill box lid 126. In some embodiments, the intermediate section 142 includes the plurality of replaceable wear plates 144. In some embodiments, the plurality of wear plates 144 is mounted to the mill box lid 126 to create the mill box lid profile.

Figure 10:
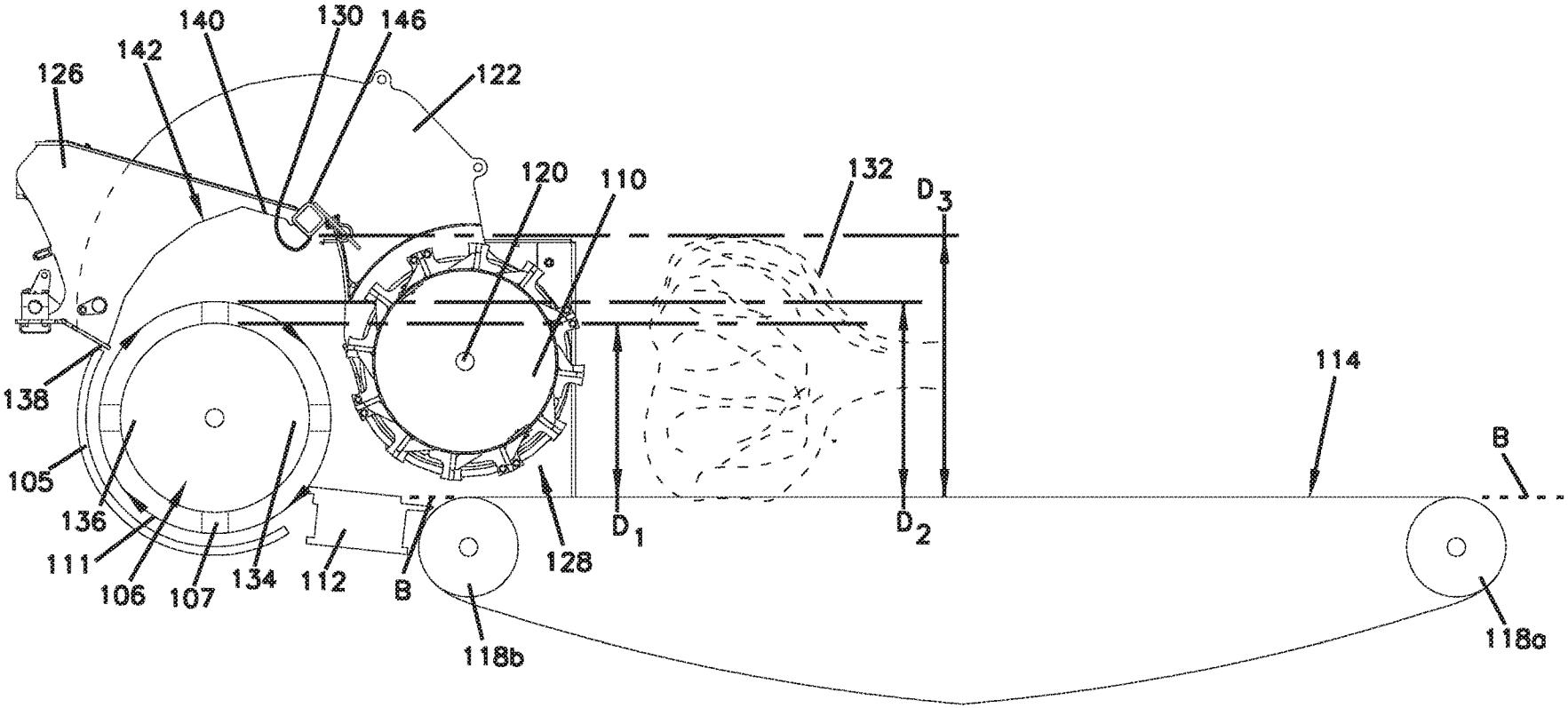
FIG. 10 illustrates a schematic side view of the horizontal grinder of FIG. 1 with the feed roller in a lowered position.
Figure 11:
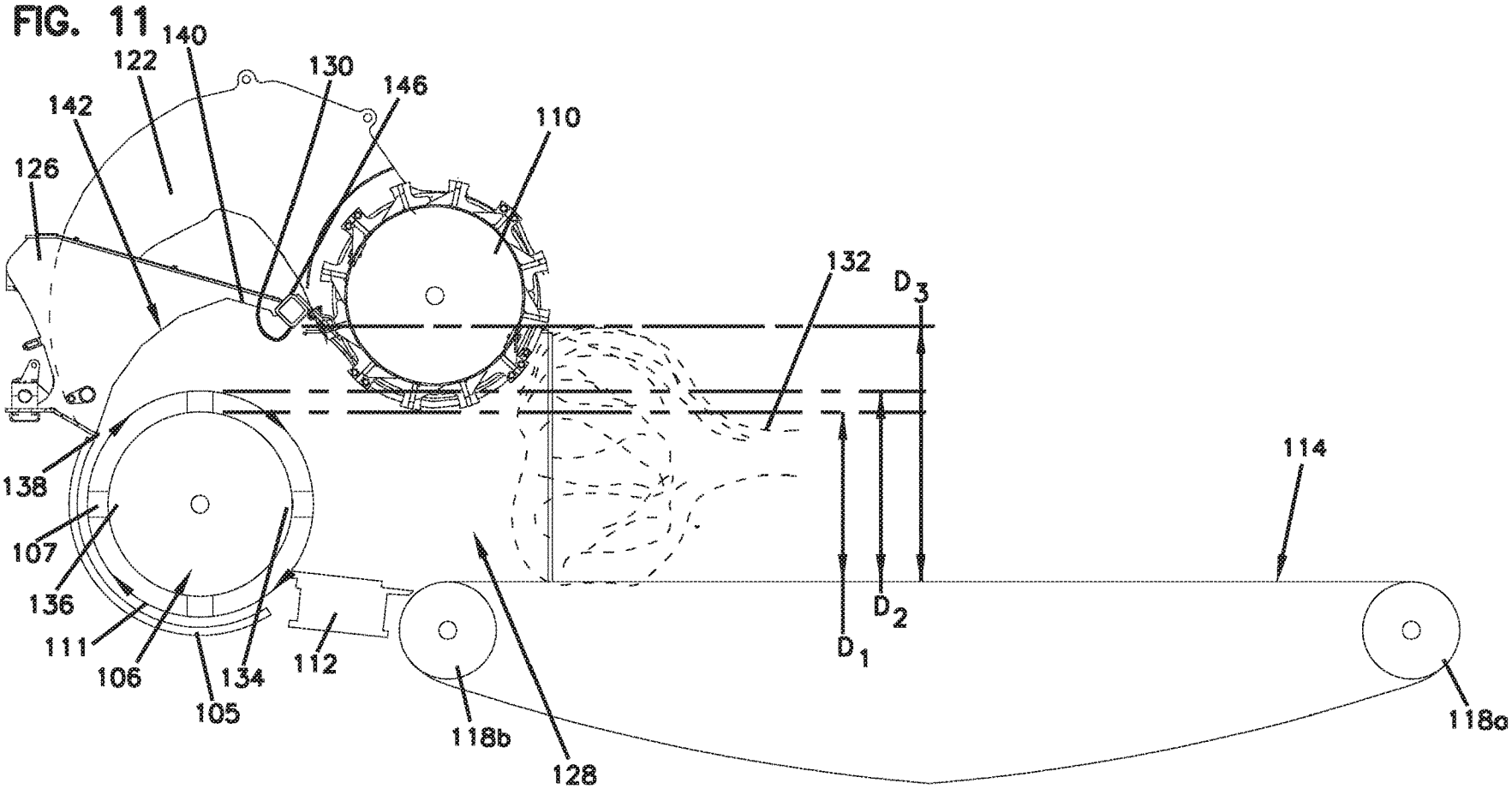
FIG. 11 illustrates a schematic side view of the horizontal grinder of FIG. 1 with the feed roller partially raised.
Figure 12:
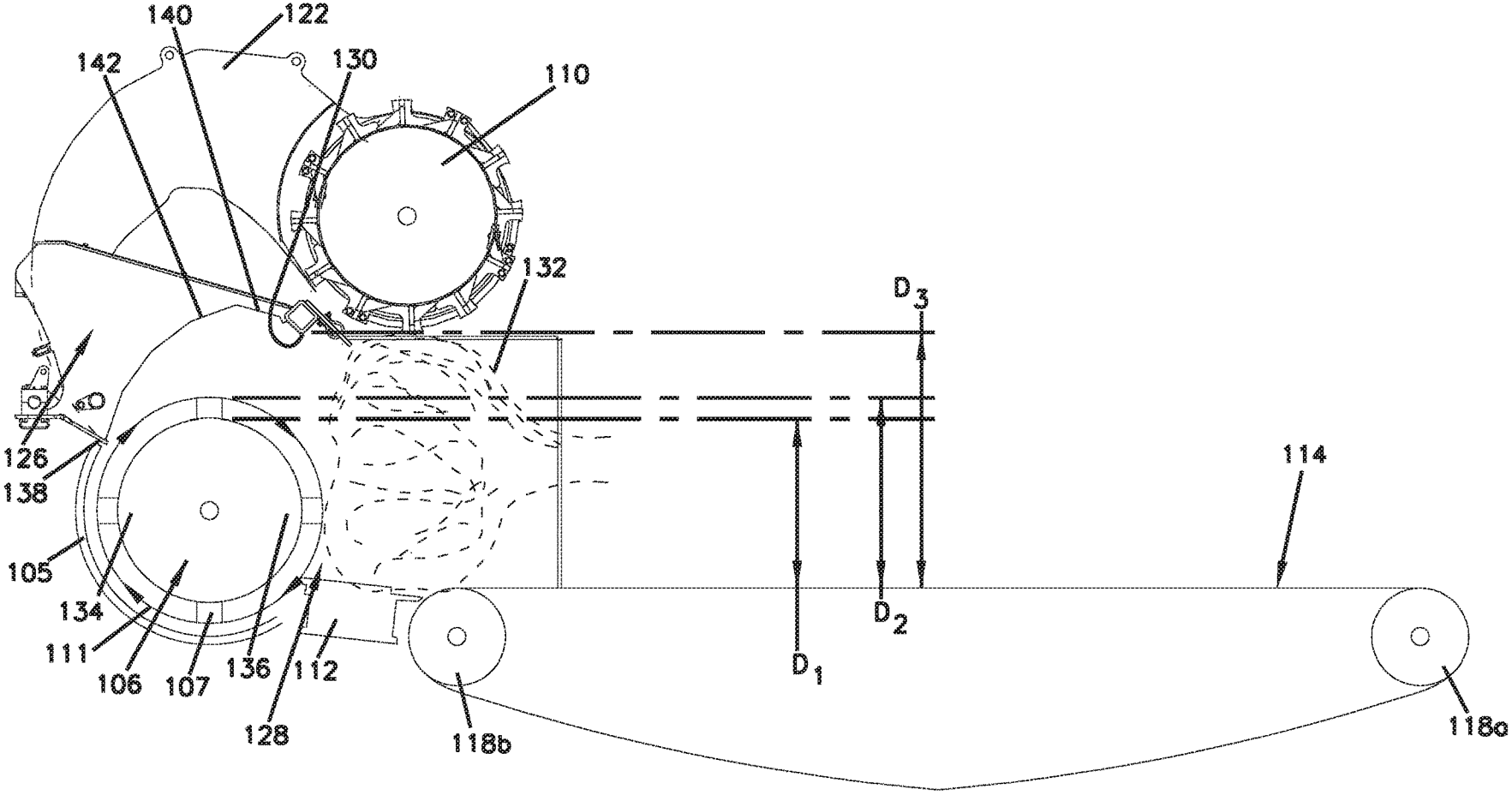
FIG. 12 illustrates a schematic side view of the horizontal grinder of FIG. 1 with the feed roller in a raised position.

FIGS. 10-12 show a schematic right side view of the horizontal grinder 100 with the feed roller 110 in a variety of different positions. Grindable material 132 is shown to be positioned on the infeed conveyor 114. The grindable material 132 shown includes a portion that rises higher off the infeed conveyor 114 than other portions of the grindable material. In some embodiments, the grindable material 132 is representative of a tree root ball.

The rotary reducing drum 106 is mounted within the mill box 104 so that a front portion 134 of the rotary reducing drum 106 is positioned adjacent the anvil 112 and a rear portion 136 is positioned at a location spaced away from the anvil 112 within the mill box 104. The rotary reducing drum 106 has a height of D1 from the infeed conveyor 114.

During a grinding operation, when the rotary reducing drum 106 is rotated, the material reducing components 107 are swept along a reducing boundary 111. In some embodiments, the reducing boundary 111 has a height D2 from the infeed conveyor 114, which is greater than the height D1 of the drum 106. The rotary reducing drum 106 is configured to be a down-cut drum and thereby configured to rotate in a direction downward toward the infeed conveyor 114 and the anvil 112. As shown from the right side in FIGS. 4-6, the rotary reducing drum 106 is configured to rotate in a clockwise direction.

A screen 105 is also shown schematically positioned at least partially around the rotary reducing drum 106. The screen 105 is configured to allow material of a desired size to pass through the screen 105 and exit the mill box 104 to be a discharged to any desired position (such as to a pile beside the grinder 100). The screen 105 is positioned under the rotary reducing drum 106 and around the rear portion 136 of the rotary reducing drum 106. In some embodiments, multiple screens 105 are used.

The mill box lid 126 is shown to be positioned above the rotary reducing drum 106. The mill box lid 126 is configured to aid in containing material within the mill box 104 during a grinding operation. Specifically, the mill box lid 126 is configured to direct material back to the rotary reducing drum 106 or infeed conveyor 114.

The mill box lid 126 has a generally arcuate profile that extends away from the reducing boundary 111 when extending from the inlet edge 138 to the outlet edge 130 in an arced direction toward the feed table 108. In some embodiments, the mill box lid 126 can have a generally continuous curved profile when extending from the inlet edge 138 to the outlet edge 130. The outlet edge 130 is positioned at a location above the front portion 134 of the rotary reducing drum 106. Further, the outlet edge 130 is positioned at a height D3 above the infeed conveyor 114. D3 is greater than the height D1 of the drum 106. D3 is also greater than the height D2 of the reducing boundary.

The inlet edge 138 of the mill box lid 126 is positioned generally at a location where the screen 105 terminates, adjacent the rear portion 136 of the rotary reducing drum 106.

The outlet portion 140 of the mill box lid 126 is configured to extend in a downward direction toward the infeed conveyor 114 when extending to the outlet edge 130. The outlet portion 140 of the mill box lid 126 is configured to direct material that travels along the profile of the mill box lid 126 in a downward direction toward the rotary reducing drum 106 and the infeed conveyor 114.

The intermediate section 142 of the mill box lid 126 is raised above the rotary reducing drum 106 and creates clearance between the mill box lid 126 and the rotary reducing drum 106. Material that is recirculated that travels the profile of the mill box lid 126 has the opportunity to reduce speed before being redirected back to the rotary reducing drum 106 or infeed conveyor 114. Further, the clearance between the mill box lid 126 and the rotary reducing drum 106 helps aid material from binding between the mill box lid 126 and the reducing boundary 111, which can reduce the operating characteristics of the rotary reducing drum 106 and increase wear on the mill box lid 126 and the rotary reducing drum 106.

With continued reference to FIG. 10, the infeed conveyor 114 is shown positioned around the conveyor rollers 118*b*, 118*a*. A conveyor plane C is defined by the infeed conveyor 114 between the two conveyor rollers 118*b*, 118*a*. The conveyor plane C is intended to be the top surface of the infeed conveyor 114 that supports the material. The bottom-most portion of a straight elongated item such as a log, will lay-on the conveyor plane C. Some materials such as short or partially ground materials can be supported by the infeed conveyor 114, but below the conveyor plane. The conveyor plane C is shown to partially intersect with the anvil 112 which is angled to be positioned at least partially above the infeed conveyor 114, and thereby the conveyor plane C.

The anvil 112 is angled upward with respect to the infeed conveyor 114. This orientation of the anvil 112 allows it to react with the material being ground to absorb the highest grinding forces, rather than allowing those forces to be transferred back into the infeed conveyor 114. The positioning of the anvil 112 also affects the way that the material is presented to the drum 106, and affects the tendency for self-feeding. Tilting the anvil 112 to a higher angle raises the point of entry, and reduces the tendency of material to self-feed. However, tilting the anvil 112 so that it is at a steeper angle causes a restriction to the movement of material towards the drum 106, thus it causes an impediment to the material in-feed.

Tilting the anvil has an additional benefit, in that at the opposite end, the end adjacent the conveyor roller, it is easier for the material to transition from the conveyor to the anvil, if the anvil is a below the conveyor plane. Thus, the positioning of the anvil 112 promotes the feeding of the material 132 from the feed table 108 to the rotary reducing drum 106.

The feed roller 110 is shown in FIG. 10 in a lowered position. In some embodiments, the feed roller 110 automatically raises and lowers in response to the height of the material 132 traveling along the infeed conveyor 114. In some embodiments, the feed roller 110 is limited to a height where its lowest point is at a height above the infeed conveyor 114 generally equal to the height D1 of the rotary reducing drum 106. In other embodiments, the feed roller 110 can be raised to a height above the infeed conveyor 114 generally equal to the height D3 of the outlet edge 130 of the mill box lid 126 (as shown in FIG. 12).

FIG. 10 shows the beginning of a grinding operation. Specifically, the material 132 is positioned on the infeed conveyor 114 moving toward the infeed opening 128. FIG. 11 shows the feed roller 110 beginning to rise by climbing the material 132 and propelling the material 132 in a direction toward the infeed opening 128. FIG. 12 shows the feed roller 110 raised to a height above the infeed conveyor 114 generally equal to the height D3 of the outlet edge 130 of the mill box lid 126. The material 132, which has a height above the infeed conveyor 114 greater than the height D1 of the rotary reducing drum 106, greater than the height D2 of the reducing boundary 111, and less than the height D3 of the mill box lid 126, is accepted into the infeed opening 128 of the mill box 104. As the material 132 enters the mill box 104, the material 132 travels up the anvil 112 and begins feeding into the rotating rotary reducing drum 106. As the material 132 is reduced by the rotary reducing drum 106, reduced material of a desired size is passed through the screen 105 and transported to another location. Material 132 not passed through the screen 105 can travel along the mill box lid 126 profile and be reintroduced to the rotary reducing drum 106 or infeed conveyor 114 until the material 132 is reduced to a size that is passable through the screen 105.

Figure 13:
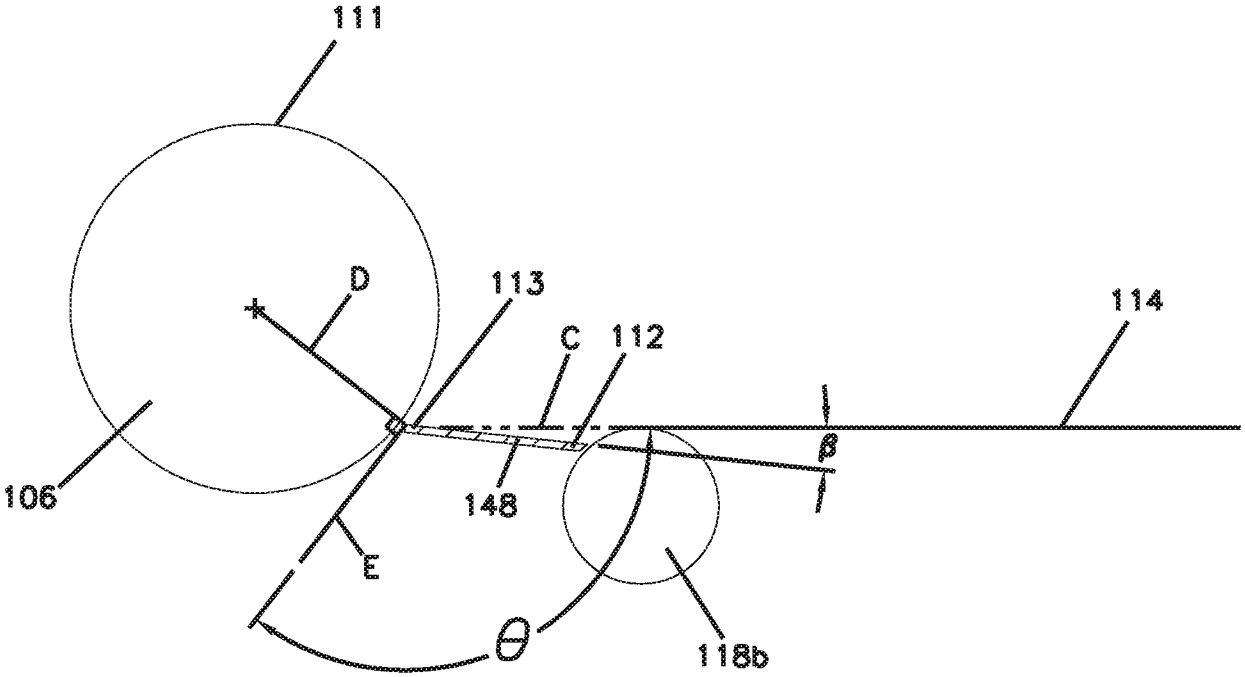
FIG. 13 illustrates a schematic side view of the horizontal grinder of FIG. 1.

FIG. 13 shows a schematic side view of the drum 106, anvil 112, infeed conveyor 114 and conveyor plane C. A first reference plane D is shown extending from the center of the drum 106 to a leading tip 113 of the anvil 112. At the leading tip 113 of the anvil 112, a second reference plane E extends away from the first reference plane D. The second reference plane E is perpendicular with the first reference plane D. The second reference plane E is shown positioned at an angle θ with the conveyor plane C. Positioning the conveyor 114 and the anvil 112 to achieve an angle θ of less than 130 degrees aids in reducing self-feeding. In some examples, the angle θ is less than 128 degrees. In some examples, angles as small as 122 degrees are believed to be practical. In some examples, it has been found that self-feeding is reduced while also having an acceptable infeed opening when the angle θ is 127 degrees.

The anvil 112 is angled in a direction upwards from the infeed conveyor 114. In some examples, at least a portion of the anvil is positioned above the conveyor plane C. The anvil 112 includes a generally planar top plate 148 that forms an angle β with the conveyor plane C. Orienting the anvil such that the angle β is less than 10 degrees has been found to provide optimum performance. It has been found that an angle of more than 10 degrees restricts the movement of material to the drum. In one embodiment, the angle β is between about 6 degrees and about 10 degrees.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A material reducing machine comprising:

a rotary reducing drum being rotatable about an axis of rotation, the rotary reducing drum defining a reducing boundary that extends at least partially around the axis of rotation;

an infeed conveyor for transporting material to a front portion of the rotary reducing drum, the infeed conveyor defining a conveyor plane;

an anvil being positioned between the rotary reducing drum and the infeed conveyor, the anvil having a leading tip positioned immediately adjacent the reducing boundary, at least a portion of the anvil extending above the conveyor plane, the anvil being positioned at a first angle with respect to the conveyor plane, the first angle being greater than or equal to 6 degrees and less than or equal to 10 degrees, wherein the anvil is also positioned at a second angle with respect to the reducing boundary of the rotary reducing drum, wherein a first reference plane extends from the axis of rotation of the rotary reducing drum to the leading tip of the anvil and a second reference plane extends downward perpendicular to the first reference plane, wherein the second reference plane forms the second angle with the conveyor plane, the second angle being between 122 degrees and 130 degrees.

2. The material reducing machine of claim 1 further comprising:

a mill box at least partially surrounding the rotary reducing drum, the mill box including:

a mill box lid mounted above the rotary reducing drum, the mill box lid having an inlet edge positioned above a rear portion of the rotary reducing drum and an outlet edge positioned above the front portion of the rotary reducing drum, wherein the mill box lid extends away from the reducing boundary when extending from the inlet edge to the outlet edge in an arcuate path toward a feed table that includes the infeed conveyor, wherein the outlet edge is positioned above an uppermost edge of the rotary reducing drum; and an infeed opening configured to receive material from the infeed conveyor, the infeed opening having an upper opening boundary defined by the outlet edge of the mill box lid.

3. The material reducing machine of claim 2, wherein the infeed opening has a lower opening boundary at least partially defined by the anvil.

4. The material reducing machine of claim 3, wherein the anvil includes a top surface, the anvil being oriented such that the anvil top surface is positioned between the rotary reducing drum and the infeed conveyor.

5. The material reducing machine of claim 2, wherein a distance from the mill box lid outlet edge to the conveyor plane is greater than the distance from the uppermost edge of the rotary reducing drum to the conveyor plane.

6. The material reducing machine of claim 2, wherein the mill box lid is comprised of a plurality of plates positioned along an arcuate curve.

7. The material reducing machine of claim 2, wherein the outlet edge of the mill box lid includes a breaker bar.

8. The material reducing machine of claim 2, wherein the mill box lid includes a pair of side plates positioned at an angle facing toward a center of the mill box lid.

9. The material reducing machine of claim 1, wherein the first angle is less than 10 degrees.

10. The material reducing machine of claim 1, wherein the first angle is 6 degrees.

11. The material reducing machine of claim 1, wherein the second angle is 127 degrees.

* * * * *